United States Patent [19]

Jian

[11] Patent Number: 4,834,402

[45] Date of Patent: May 30, 1989

[54] WOODEN HORSE ABLE TO MOVE FORWARDS AND TO CHANGE MOVING DIRECTION

[75] Inventor: Cheng-Ming Jian, Taipei, Taiwan

[73] Assignee: Yeou-Wei Gong, Chu-chi, Taiwan

[21] Appl. No.: 70,379

[22] Filed: Jul. 6, 1987

[51] Int. Cl.[4] ..... A63G 17/00

[52] U.S. Cl. ..... 280/1.175; 272/52.5; 280/1.181; 280/219

[58] Field of Search ..... 280/1.13, 1.175, 1.177, 280/1.181, 1.182, 1.183, 1.184, 1.193, 218, 219; 272/52, 52.5, 53.1, 53.2

[56] References Cited

U.S. PATENT DOCUMENTS 94,858 9/1869 Anderson ..... 280/1.175
150,121 4/1874 Anderson ..... 280/1.175

FOREIGN PATENT DOCUMENTS 412180 11/1945 Italy ..... 280/1.175
413815 5/1946 Italy ..... 280/1.175

*Primary Examiner*—Charles A. Marmor
*Assistant Examiner*—Everett G. Diederiks, Jr.

[57] ABSTRACT

A rocking horse capable of moving forward and of changing its moving direction. The horse has two curved pitching rods, two movable support rods, and two rider controllable L-shaped levers with pedals. By manipulating the pedals, the rider can rock back and forth on the same spot, move the horse forward, or change the horse's moving direction.

2 Claims, 4 Drawing Sheets

WOODEN HORSE ABLE TO MOVE FORWARDS AND TO CHANGE MOVING DIRECTION

BACKGROUND OF THE INVENTION

A wooden horse usually comprises a horse body with two handles on the horse head, two curved pitching rods mounted under the horse legs so as to cause the horse to pitch back and forth upon a player riding on. The child would then enjoy the pleasure as if riding on a real horse.

However, the conventional wooden horse can only pitch back and forth on the same spot, being unable to move forwards, to turn in other directions, or to have more pleasure as if riding a real horse. In view of the aforesaid drawbacks, the inventor has, through repeated studies, developed a new wooden horse, which can move forwards, and can turn in other directions. According to the present invention, the wooden horse is furnished with two movable supporting rods behind the front legs of the horse respectively. By means of that rods, the wooden horse can move forwards, can turn in other directions, or can pitch back and forth on the same spot; by means of the aforesaid features, the wooden horse of the present invention can be used by children to conduct a contest to gain more fun. Further, the wooden horse according to the present invention can also be used for training the children's ability to select and to operate a toy so as to cultivate their response in handling matters.

SUMMARY OF THE INVENTION

This invention relates to a wooden horse able to move forwards and to change moving direction. The main feature of the present invention is that two movable supporting rods are mounted behind the two front legs of the horse respectively with the lower ends of that rods being extended slightly out of the bottom surface of the curved pitching rods. When the wooden horse pitching back and forth, the movable supporting rods will hit the ground to cause the horse to move forwards as a result of inertia effect; in that case, the lower end of the movable supporting rod is used as the center of a circle, while the length of the movable supporting rod is used as the radius of the circle to cause the horse to move forwards at a short distance.

Moreover, each of the movable supporting rods is mounted with a L-shaped lever, of which one end is in contact with the front side of the movable supporting rod, while the other end is formed into a pedal. When a player steps down the pedal, the movable supporting rod will be pushed backwards to a position not extending out of the curved pitching rod, i.e., not touching the ground surface. In that case, the wooden horse can be turned in other direction, or can be pitching on the same spot to provide the player with fun.

The major object of the present invention is to provide a wooden horse which can train the children's selecting and operating capabilities so as to learn the simple transmission theory through amusement.

Another object of the present invention is to provide a wooden horse, which has two movable supporting rods and two L-shaped levers; the L-shaped lever can make one or both of the movable supporting rods lifted backwards so as to let the wooden horse change its moving direction or pitch on the same spot. The wooden horse would move forwards upon the L-shaped levers being released completely.

DETAILED DESCRIPTION

Figure 1:
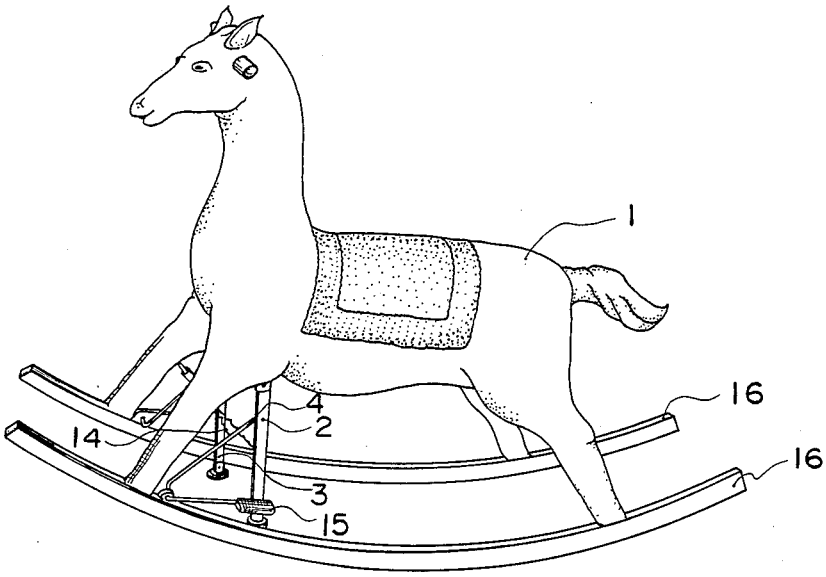
FIG. 1 is a perspective view of the present invention.

Referring to FIG. 1, there is shown a perspective view of the wooden horse 1 according to the present invention, in which two movable supporting rods 2 are mounted behind the two front legs of the wooden horse respectively. The length of the movable supporting rod 2 is slightly longer than the distance from the pivotally fixed end of the rod 2 to the bottom of the curved pitching rod 16, for instance about 1–3 cm; the movable supporting rod is to be used as a fulcrum during the wooden horse pitching up and down so as to force the wooden horse to move forwards at a short distance. In the front of the movable supporting rod 2, there is a L-shaped lever 3, of which one end is in contact with the front side of the rod 2, while the other end thereof is formed into a pedal 15. When a player steps on the pedal 15, the movable supporting rod 2 can be lifted from the ground surface; when a player releases the pedal 15, the rod 2 will touch the ground surface. The movable supporting rod 2 is mounted under the front part of the wooden horse at an angle about 2–5 degrees larger than its perpendicular angle to the ground, being inclined backwards. Each of the movable supporting rods 2 is loaded with a spring 4 so as to maintain the rod 2 at its normal angle after each time the wooden horse pitching and moving. One end of the spring 4 is fastened to the middle front side of the rod 2, while the other end thereof is fastened to the front leg of the wooden horse 1. Another spring 14 is to maintain the L-shaped lever 3 and the supporting rod 2 in an independent state when the wooden horse is pitching and moving forwards; in other words, the spring 14 is not used upon the wooden horse pitching at a spot. One end of the spring 14 is fastened to the L-shaped lever 3, while the other end is fastened to the front leg of the wooden horse 1.

Figure 2:
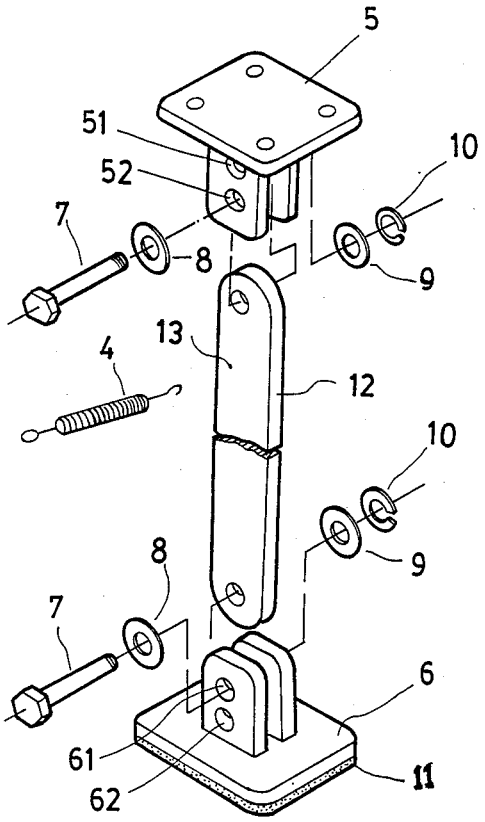
FIG. 2 is a disassembled view of the movable supporting rod according to the present invention.
Figure 4:
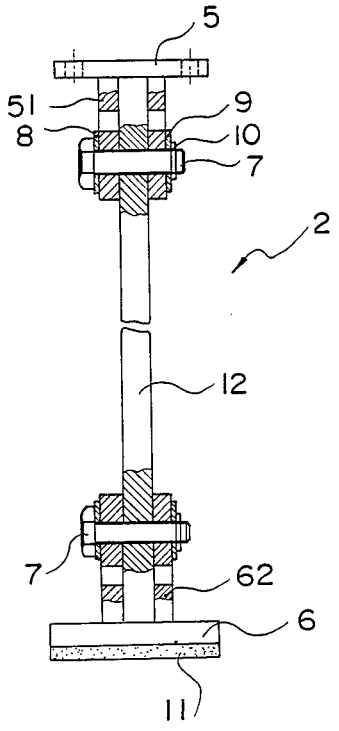
FIG. 4 is a sectional view of the movable supporting rod of the present invention.
Figure 3:
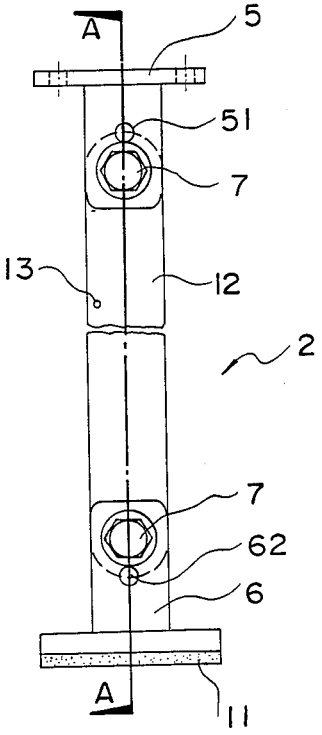
FIG. 3 is a front view of the movable supporting rod of the present invention.

Referring to FIGS. 2, 3, and 4, the movable supporting rod 2 comprises an upper base 5, a lower base 6, and a linking rod 12. Both ends of the upper base 5 and the lower base 6 are furnished with round holes 51, 52, 61 and 62 respectively so as to use one of the holes at each end to fasten with the linking rod 12 through a hole on the rod by means of bolts 7 and washers 8, 9 and retaining rings 10 to form into a pivotally connected manner. The round holes 51, 52, 61 and 62 on the upper and lower bases 5 and 6 are used for adjusting the length of the movable supporting rod 2 so as to determine the forwardly moving distance of the wooden horse each time. The bottom surface of the lower base 6 is attached with a soft pad 11 made of rubber or plastics so as to increase the friction effect between the ground surface and the lower base 6 and to insure the operation safety and to eliminate noise upon the wooden horse moving forwards.

Figure 5:
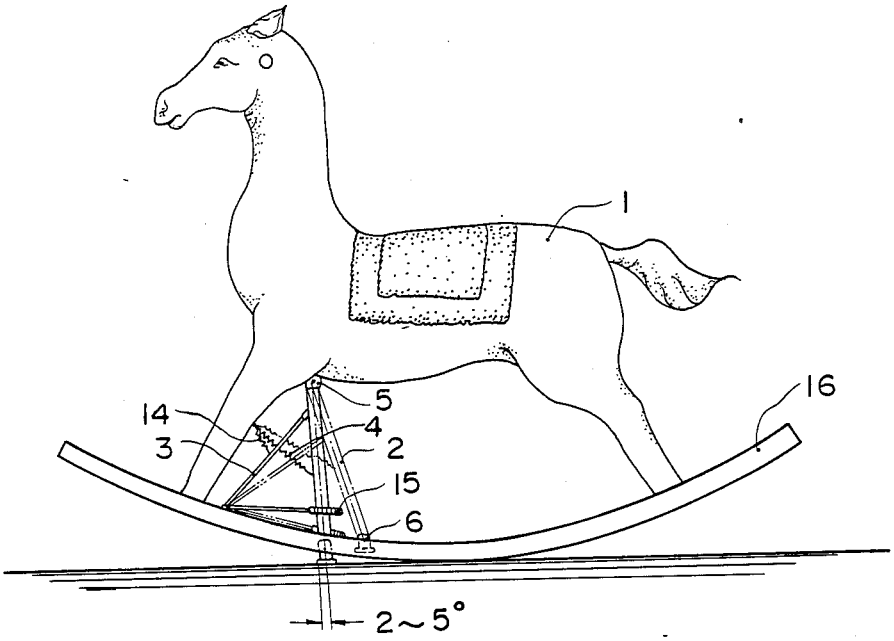
FIG. 5 illustrates the movable supporting rod being controlled with the L-shaped lever in the present invention.

FIG. 5 illustrates how the L-shaped lever 3 controls the movable supporting rod 2. When the wooden horse is pitching, the player may step on the pedal 15 to cause the L-shaped lever 3 to lift the movable supporting rod 2 over the ground surface; otherwise, the movable supporting rod 2 would touch the ground to force the wooden horse to slide forwards. When requiring the wooden horse to turn in one direction, step down one related pedal to cause one of the movable supporting rod 2 to be lifted above the ground surface, and the wooden horse will turn in that direction immediately. It is rather simple to control the wooden horse to move forwards, to turn or to pitch on the same spot.

Figure 6:
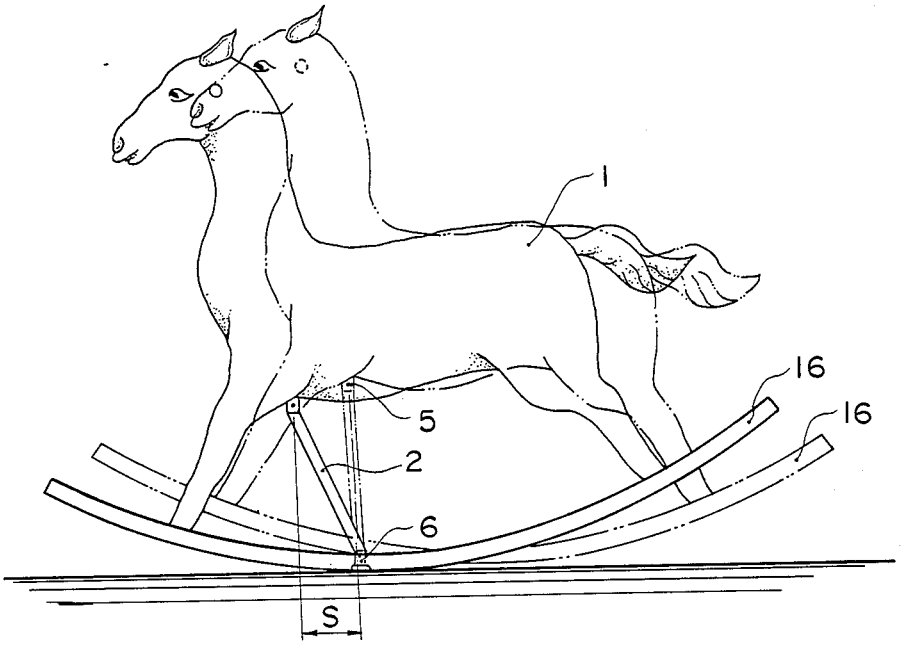
FIG. 6 illustrates the wooden horse according to the present invention to move forwards.

FIG. 6 illustrates the wooden horse pitching on the spot without moving; in that case, the movable supporting rods 2 do not touch the ground surface, but only a given portion of the curved pitching rod 16 of the horse touches the ground surface. When the lower base 6 of the movable supporting rod 2 touching the ground surface, there are two portions on the horse to touch the ground; in that case, the angle of the movable supporting rod 2 is greater by 2–5 degrees than its perpendicular angle. As a result of the pitching inertia of the wooden horse, the movable supporting rod 2 and the touching portion of the pitching rod 16 to the ground fall almost on the same spot, and therefore the wooden horse will be moved forwards at a short distance "S". The theory is something like a running real horse, of which the four legs fall almost on the same spot when jumping forwards; the theory is also something like the snow skiing exercise. By means of the aforesaid structures and theory, the wooden horse can move forwards upon pitching; by using the L-shaped lever 3, the movable supporting rod 2 can change its length and angle to cause the wooden horse to turn in either direction during moving forwards.

I claim

1. A rocking horse comprising :

a horse body mounted on two curved rods upon which said horse body can rock back and forth;

a pair of movable supporting rods each including an upper base fixed to an underside portion of the horse body, a lower base adapted to contact the ground surface, and a linking rod having upper and lower holes therein, said upper base including a pair of upper lugs depending therefrom, said upper lugs having two sets of aligned holes therein, said lower base including a pair of lower lugs depending therefrom, said lower lugs having two sets of aligned holes therein, said linking rod being interconnected between said upper and lower bases by connecting means which extend through respective aligned holes in said bases and said linking rod with the additional holes in said lugs permitting adjustability of length of said supporting rods;

a pair of L-shaped levers each being pivotally connected at the mid-bent portion to a respective one of said curved rods, each of said L-shaped levers having one end in contact with a front side of a respective one of said supporting rods and the other end thereof having a pedal thereon, whereby when a rider on said horse body rocks said horse said rider can, by means of said pedals, lift said supporting rods off the ground surface such that said horse can rock back and forth on the same spot, step down on only one of said pedals in order to turn said horse, or step down on both pedals to make said horse move forwards a given distance.

2. A rocking horse as claimed in claim 1, wherein each of said supporting rods is biased by a spring to its rest position, one end of each spring being fastened to a middle portion of a corresponding support rod and the other end thereof being fastened to a corresponding front leg of said wooden horse; and a pair of pulling springs, each pulling spring extending between one of said L-shaped levers and a corresponding front leg of said wooden horse.

* * * * *